United States Patent [19]

Garcia

[11] 4,170,374

[45] Oct. 9, 1979

[54] CLOSURE LATCH

[76] Inventor: Fortunato C. Garcia, 5830 Limerick, Corpus Christi, Tex. 78413

[21] Appl. No.: 849,700

[22] Filed: Nov. 8, 1977

[51] Int. Cl.[2] ..... E05C 3/16

[52] U.S. Cl. ..... 292/201

[58] Field of Search ..... 292/201, 122, 124, DIG. 72

[56] References Cited

U.S. PATENT DOCUMENTS

| | | | |
|---|---|---|---|
| 1,431,040 | 10/1922 | Rawlings | 292/DIG. 72 |
| 2,223,876 | 12/1940 | Scanlan | 292/124 X |
| 3,016,968 | 1/1962 | Lenz et al. | 292/201 X |

*Primary Examiner*—Richard E. Moore

*Attorney, Agent, or Firm*—G. Turner Moller

[57] ABSTRACT

There is disclosed a heavy duty closure latch particularly adapted for use on delivery trucks incorporating a remotely operable electrically powered device for unlatching the latch. A separate manually operable unlatching mechanism is provided adjacent the closure for moving the latch and electrically powered mechanism in an opening direction to provide a separate means for unlatching the latch.

8 Claims, 7 Drawing Figures

CLOSURE LATCH

This invention relates to closure latches and more particularly to remotely powered vehicle body closure latches.

Delivery trucks are widely used in commerce to deliver a wide variety of articles, for example parcels, soft drinks, bread, dairy products and the like. Such delivery trucks typically provide an enclosure of substantial size running from immediately behind the driver's seat to the end of the vehicle. A closure is provided at the rear of the vehicle affording access to the enclosure and is normally equipped with a conventional lock. An additional closure, known as a bulkhead door, is normally provided immediately behind the driver's seat providing another access to the enclosure.

Because of the value of the articles in the enclosure, the closure is normally locked. When the driver or deliveryman reaches a destination where an article is to be delivered, the driver turns off the vehicle engine, unlocks the padlock on the bulkhead door, opens the bulkhead door, retrieves the article to be delivered, recloses the bulkhead door, locks the padlock and then delivers the article. Because many delivery situations require the driver to make 20–200 separate deliveries per day, it will be evident that locking and unlocking the bulkhead door amounts, in the aggregate, to a substantial expenditure of time and effort.

There are, of course, remotely operable vehicle body closures and latch mechanisms therefor. A typical example is found in an automobile having a remote trunk release. Remote trunk releases of the type presently available incorporate a vacuum operated motor arranged to unlatch the trunk latch mechanism upon the application of vacuum thereto. Another type of remotely operable vehicle body closure latch incorporates an electric motor. Typical examples of the latter are found in U.S. Pat. Nos. 3,332,713 and 3,566,703. These devices incorporate an electrically driven motor and a gear train operatively connected to move the latch to the latched position and to move the latch from the latched position. One of the difficulties with the prior art devices of this type is that the supplemental mechanical operator for the latch mechanism is rather awkward and usually requires the electrically operable mechanism to be reset after the closure has been mechanically opened.

The present invention overcomes the foregoing and other drawbacks of the prior art and provides a novel and improved power operated closure latch.

The latching mechanism of this invention is preferably affixed to a stationary member adjacent the closure opening. A striker member is carried by the door for movement into engagement with a latch member biased toward the closed position. The latch member provides a camming surface and is biased by the striker away from the latch closed position until the striker clears the cam face whereupon the latch member moves to a latched position thereby captivating the striker.

In one embodiment of the invention, the latch member is pinned or otherwise connected directly to the output of an electric solenoid. The solenoid includes a spring mechanism biasing the output member and latch toward the latch closed position. Upon energization of the solenoid, the output member retracts thereby moving the latch to the unlatched position. A spring, compressed during closing movement of the striker, acts to move the striker member away from the closed or latched position.

A separate mechanically operable unlatching device extends through the stationary member to which the latch mechanism is attached and provides a cylinder lock having a cam on one end thereof for moving the latch member and the solenoid output in an opening direction to release the striker member from the latched position. When the cylinder lock is released, the spring in the solenoid returns the latch member to the latched position so that resetting of the solenoid is not required.

In another embodiment of the invention, an electric motor is provided having a geared output in meshing engagement with a sector gear connected to the latch member. Manipulation of the separate mechanically operable latching device acts to drive the sector gear in an opening direction which drives the geared output in a reversing direction. A spring is provided to bias the latch member toward the latch closed position.

An electric circuit is provided to energize the electrically powered mechanism and includes a pair of parallel switches in series with the truck ignition switch. One of the parallel switches is preferably mounted adjacent the driver's seat, for example on or under the dash board, while the other of the parallel switches is desirably mounted adjacent the closure.

It is an object of this invention to provide an improved delivery truck having an improved novel and heavy duty latch mechanism which is particularly adapted for high use situations.

Other objects and a fuller understanding of the invention may be had by referring to the following description and claims taken in conjunction with the accompanying drawings.

Figure 1:
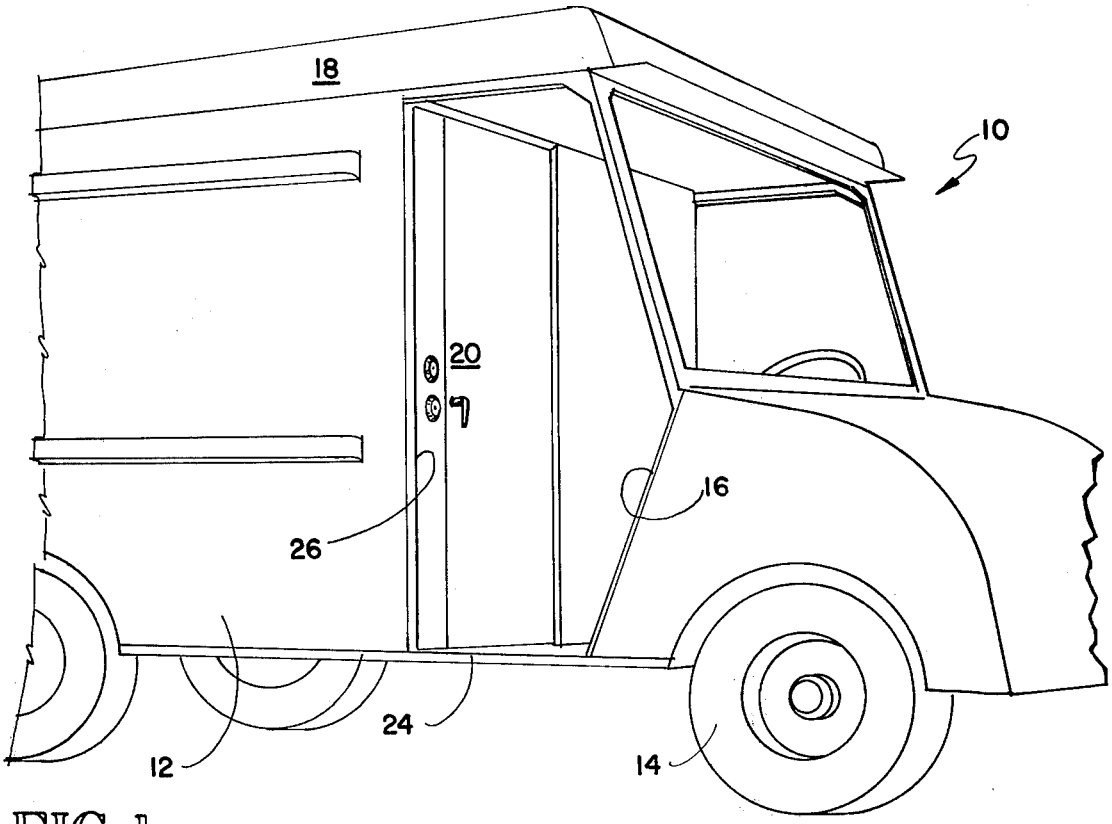
FIG. 1 is an isometric view of a delivery truck.

Referring to FIG. 1, there is illustrated a delivery truck 10 comprising a chassis 12 having a plurality of wheels 14, a driver's compartment accessible through an opening 16 and a large enclosure 18 for the articles to be carried which is accessible through a bulkhead door 20.

Figure 2:
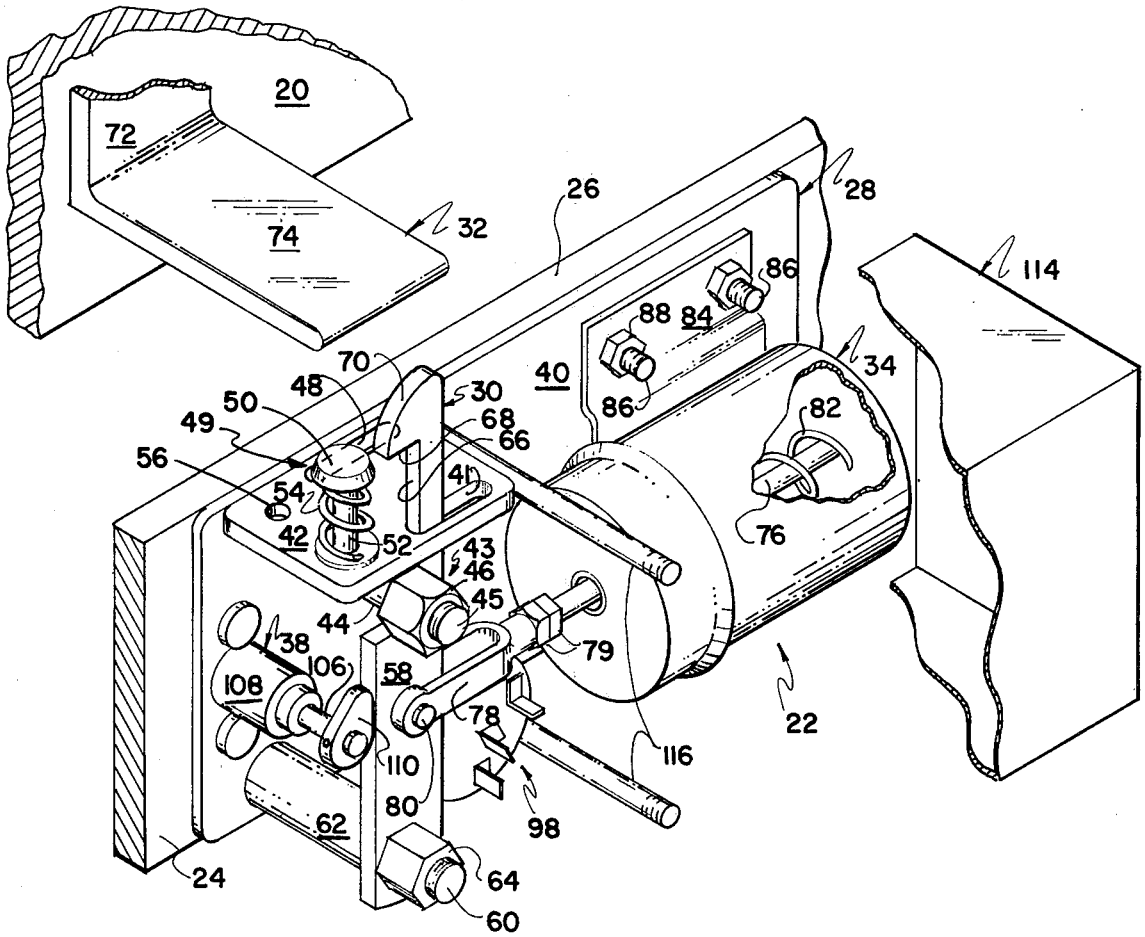
FIG. 2 is a rear isometric view of the latch mechanism of this invention.

Referring to FIG. 2, there is illustrated a closure latch 22 of this invention mounted on a stationary member 24 of the delivery truck 10 providing part of a closure opening 26 closed by the door 20 which is illustrated as a vertical sliding door. The closure latch 22 comprises, as major components, a framework 28 affixed to the stationary member 24, a latching element 30 mounted on the framework 28 for movement between latching and unlatching positions, a striker member 32 carried by the door 20 for movement between open and closed positions, an electrically powered mechanism 34 for moving the latch element 30 to the unlatched position thereof upon energizing the mechanism 34, a circuit 36

(FIG. 4) for energizing the mechanism 34 and a mechanically operable unlatching device 36 for moving the latch element 30 to the unlatched position.

The framework 28 comprises a metal plate 40 secured in any suitable fashion to the stationary member 24 and a transversely situated platform 42 removably connected to the plate 40 by an arrangement 43 including a sleeve 44 connected to the platform 42, a threaded stud 45 connected to the plate 40 and a nut 46 threaded onto the stud 45. The platform 42 provides a pair of slots 47, 48 through one of which extends the latch element 30. As illustrated in FIG. 2, the latch element 30 extends through the slot 47 adjacent a spring stop 49 comprising a rubber boot 50 mounted on a shank 52 and biased by a spring 54 away from the platform 42. The platform 42 also comprises a second passage or opening 56 aligned with the slot 48 for purposes more fully explained hereinafter.

The latch element 30 comprises a member 58 pivotally mounted on a threaded shank 60 and captivated between an enlarged collar 62 and a nut 64. The member 58 is accordingly free to move between a latching position illustrated in FIG. 2 and an unlatching position (not shown) displaced clockwise from the showing of FIG. 2. The upper end of the member 58 is recessed at 66 to provide a latching shoulder 68 for engaging and holding the striker member 32. The upper end of the member 58 provides an arcuate camming surface 70 for engaging the striker member 32 and moving the latch element 30 away from the latching position to allow the striker member 32 to engage the latching shoulder 68.

The striker member 32 may be of any convenient type and is illustrated as a generally L-shaped bracket having one leg 72 affixed to the door 20 and a transverse or perpendicular leg 74 extending away from the door 20 in a path of movement to engage the camming surface 70 and rubber boot 50.

In the embodiment of FIG. 2, the electrically powered mechanism 34 is of the solenoid type having an appropriately wound coil (not shown) and a reciprocable output member 76 having an outer end threadably received in the end of a clevis 78 with a pair of nuts 79 providing an adjustment of this connection for altering the effective stroke of the output member 76. The clevis 78 is connected by a pin 80 to the latch member 58. The output member 76 is biased in a latch closing direction in any suitable fashion, as by the provision of a spring 82. The mechanism 34 is affixed to the framework plate 40 by a suitable bracket 84 received on a plurality of threaded studs 86 and captivated thereto by suitable nuts 88.

Figure 4:
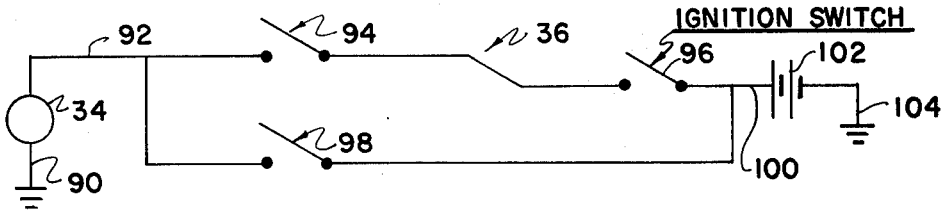
FIG. 4 is a schematic diagram of an electric circuit suitable to energize the electrically powered mechanism of FIG. 2.
Figure 3:
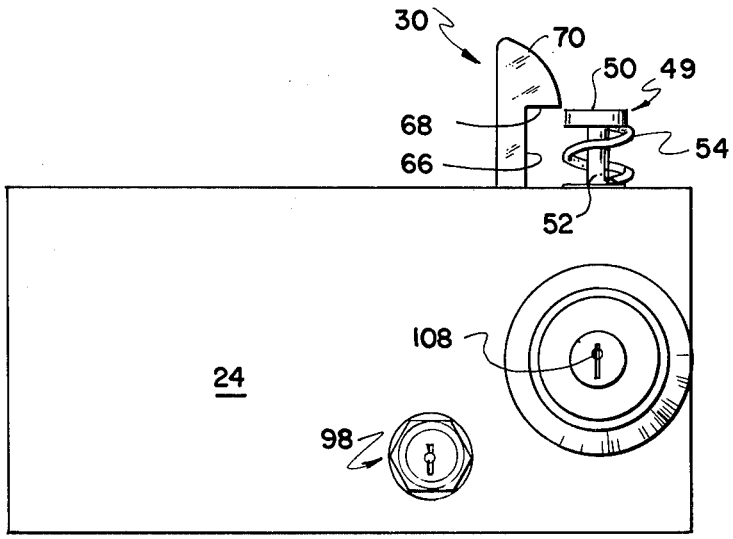
FIG. 3 is a front view of the latch mechanism of FIG. 2.

Referring to FIG. 4, the circuit 36 includes the mechanism 34 in which one lead 90 thereof is connected to ground while the other lead 92 is connected to a switch network. The switch network comprises a dash mounted switch 94 in series with the ignition switch 96 of the delivery truck 10 and a third switch 98 in parallel with the switches 94, 96. The switching network is connected by a lead 100 to a battery 102 or other suitable power source having a grounded lead 104. The switch 98 is preferably mounted adjacent the closure opening 26 and most desirably is mounted on the framework plate 40 as shown in FIG. 2. As is evident from FIG. 3, the switch 98 is of the key-operated variety and is exposed through the stationary member 24 to the exterior of the enclosure 18 of the delivery truck 10. It will be apparent that the mechanism 34 can be actuated to unlatch the latch element 30 either by manipulating the dash mounted switch 94 before the ignition switch 96 is turned off or by actuating the key-operated switch 98.

The mechanically operable unlatching device 38 comprises a shaft 106 on the end of a cylinder lock 108 mounted on the plate 40. The cylinder lock 108 extends through the plate 40 and the stationary member 24. Attached to one end of the shaft 106, inside the enclosure 18, is a cam 110 positioned to engage the member 58 when the cylinder lock 108 is turned with a key and out of engagement with the member 58 when the cylinder lock 108 is locked. The cylinder lock 108 is affixed to the shaft 106 and can be turned to move the latch element 30 away from the latched position toward the unlatched position. It is seen that turning of the lock 108 and moving of the latch element 30 also causes retracting movement of the solenoid output 76 against the bias of the spring 82.

The closure latch 22 may be substantially enclosed by a rectilinear housing 114 fixed to the framework plate 40 in any suitable fashion, as by the provision of one or more threaded studs 116 having suitable nuts (not shown) thereon.

In use, the driver of the truck 10 arrives at the location where a parcel is to be delivered. After stopping the truck but before turning off the ignition switch 96, the driver manipulates the switch 94, which is in the driver's compartment. Closing of the switch 94 prior to opening of the ignition switch 96 completes a circuit through the solenoid 34 thereby retracting the output 76 and moving the latch element 30 to an unlatching position. The bias of the spring 54 acts to elevate the striker member 32 above the level of the latching shoulder 68.

The driver leaves the driver's seat and approaches the bulkhead door 20 which is slightly ajar. The driver opens the door 20, removes the desired parcel from the enclosure 18 and slams the door 20 shut. During closing movement, the striker leg 74 engages the camming surface 70 thereby moving the latch element 30 in a clockwise direction as viewed in FIG. 2 until the upper surface of the striker leg 74 clears the latching shoulder 68. Contemporaneously with camming open of the latch element 30, the striker leg 74 engages the rubber boot 50 and compresses the spring 54. As soon as the latching shoulder 68 clears the striker leg 74, the latch element 30 is biased into latching position by the spring 82. The door 20 is accordingly locked whereby the driver can deliver the selected parcel without fumbling for keys or with a padlock.

If the driver fails to manipulate the switch 94 upon stopping the truck 10 or the driver returns to the truck 10 to retrieve additional parcels, two separate or alternative techniques are provided for unlatching the door 20. First, the driver may utilize a key to close the key operated switch 98 thereby energizing the solenoid 34 and uncoupling the latch element 30 and striker member 32. Second, the driver may utilize a key to unlock the cylinder lock 108 to turn the cam 110 thereby moving both the latch element 30 and solenoid output in a latch opening direction to uncouple the latch element 30 from the striker member 32.

Figure 5:
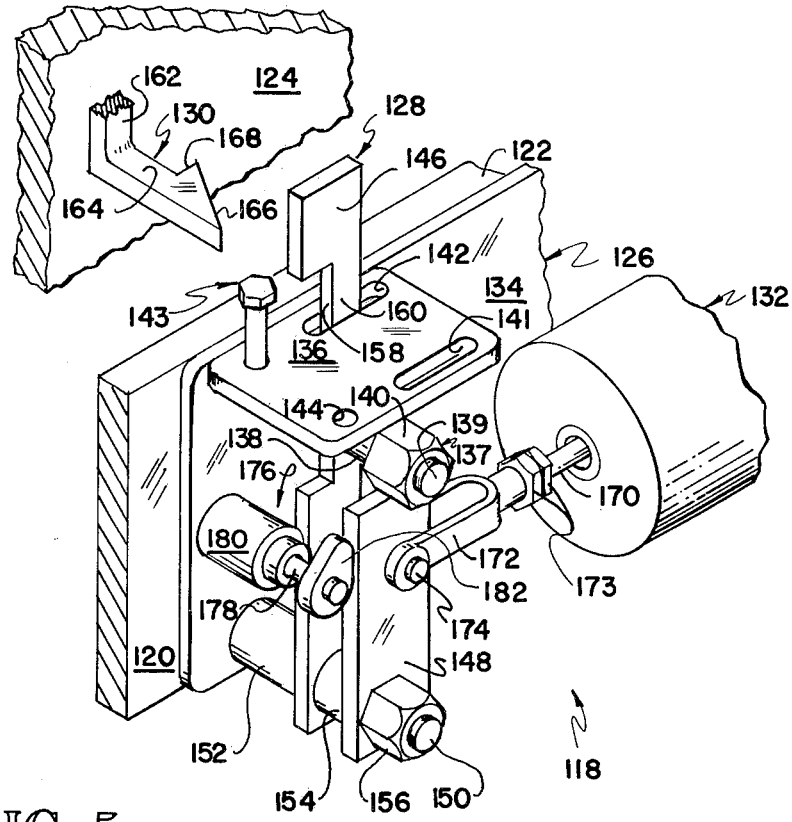
FIG. 5 is a partial rear isometric view of another embodiment of this invention.

Referring to FIG. 5, there is illustrated another embodiment of a closure latch 118 mounted on a stationary member 120 of a delivery truck providing part of a closure opening 122 closed by a swinging door 124. The closure latch 118 comprises, as major components, a framework 126 affixed to the stationary member 120, a latching element 128 mounted on the framework 126 for pivotal movement between latching and unlatching positions, a striker member 130 carried by the door 124 for movement between open and closed positions, and an electrically powered mechanism 132 for moving the latch element 128 to the unlatched position thereof upon energizing the mechanism 132.

The framework 126 comprises a metal plate 134 secured in any suitable fashion to the stationary member 120 and a transversely extending platform 136 removably connected to the plate 134 by an arrangement 137 including a sleeve 138 connected to the platform 136, a threaded stud 139 connected to the plate 134 and a nut 140 threaded onto the stud 139. The platform 136 provides a pair of slots 141, 142 through one of which extends the latch element 128. As illustrated in FIG. 5, the latch element 128 extends through the slot 142 adjacent a stop 143 comprising an upstanding abutment secured to the platform 136. The platform 136 also comprises a passage or opening 144 aligned with the slot 141. It will be seen that the frameworks 28, 126 are substantially identical and may be converted for cooperation with either sliding or swinging doors.

The latch element 128 comprises a first member 146 extending through the slot 140 and a second member 148 connected to the first member 146 by a crosspiece (not shown). The first and second members 146, 148 are pivotally mounted on a threaded shank 150 and are captivated between a pair of enlarged collars 152, 154 and a nut 156. The members 146, 148 are accordingly free to move together between a latching position illustrated in FIG. 5 and an unlatching position (not shown) displaced clockwise from the showing of FIG. 5. The upper end of the member 146 is recessed at 158 to provide a latching shoulder 160 for engaging and holding the striker member 130. The side of the member 146 opposite from the shoulder 160 provides a camming surface for engaging the striker member 130 and moving the latch element 128 away from the latching position to allow the striker member 130 to engage the latching shoulder 160.

The striker member 130 may be of any convenient type and is shown as a generally L-shaped bracket having one leg 162 affixed to the door 124 and a transverse perpendicular leg 164 extending away from the door 124 in a path of movement to engage the camming surface of the member 146. On the end of the leg 164 is a camming surface 166 for engaging the camming surface on the member 146 and a shoulder 168 for engaging the latching shoulder 160.

In the embodiment of FIG. 5, the electrically powered mechanism 132 is of the solenoid type having an appropriately wound coil (not shown) and a reciprocable output member 170 threadably received in the end of a clevis 172 with a pair of nuts 173 providing an adjustment for varying the effective stroke of the output member 170. The clevis is connected by a pin 174 to the latch member 128. The output member 170 is biased in a latch closing direction in any suitable manner, as by the provision of a spring (not shown) operatively connected to the output member 170. The mechanism 132 is affixed to the plate 134 in any convenient manner, as for example in the manner shown in FIG. 2.

The electrically powered mechanism 132 is energized and deenergized in any suitable fashion, as for example by the circuit 36 illustrated in FIG. 4.

The closure latch 118 also comprises a mechanically operable latching device 176 comprising a shaft 178 on the end of a cylinder lock 180 mounted on the framework plate 134. The cylinder lock 180 extends through the framework plate 134 and the stationary member 120. Attached to one end of the shaft 178, inside the closure of the delivery truck 10, is a cam 182 positioned to engage the second member 148 when the cylinder lock 180 is turned with a key and is out of engagement with the member 148 when the cylinder lock 180 is locked. The cylinder lock 180 is affixed to the shaft 178 and can be turned to move the latch element 128 away from the latched position toward the unlatched position. It will be evident that turning of the cylinder lock 180 and moving of the latch element 128 also causes retracting movement of the solenoid output 170 against the bias afforded by its associated spring (not shown).

In use, the closure latch 118 is operable in substantially the same fashion as the closure latch 22. The primary difference between the embodiments 22, 118 is that the embodiment 22 is adapted to close a striker member carried on a vertically sliding door whereas the embodiment 118 is adapted to latch a striker carried by a swinging door. It will be evident that the only change in the mechanism is in the configuration of the latch element 30, 128 and the positioning thereof relatively closer or relatively farther from the stationary member 24, 120. It will be evident that this flexibility allows the assembly of a variety of closure latches of substantially identical operation adapted to cooperate with doors of different operational characteristics with a minimum of parts.

Figure 6:
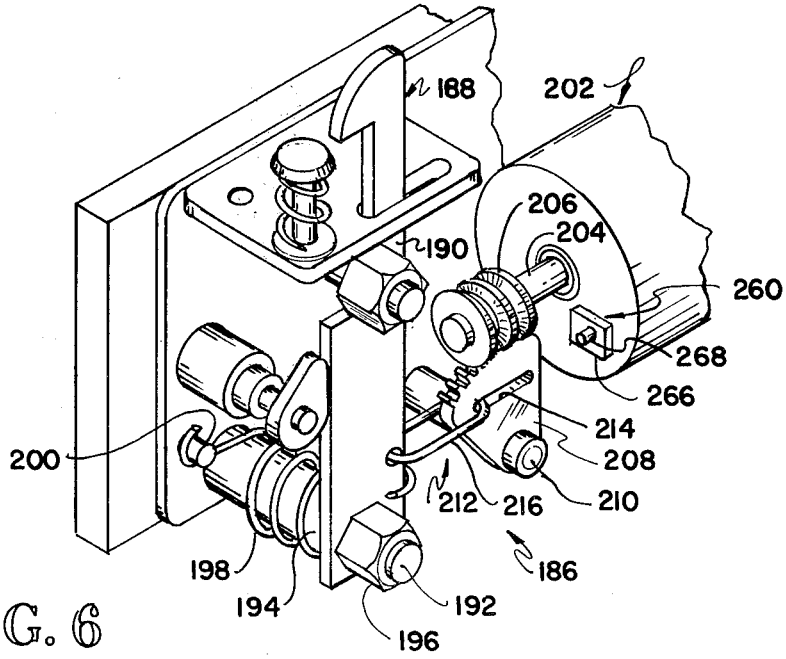
FIG. 6 is a partial rear isometric view of a further embodiment of the invention.

Referring to FIG. 6, there is illustrated another embodiment of a closure latch 186 of this invention which is substantially identical to the embodiment of FIG. 2 except for the means for manipulating a latch element 188. The latch element 188 comprises a latch member 190 pivotally mounted on a threaded shank 192 captivated between an enlarged collar 194 and a nut 196. The member 190 is accordingly free to move between a latching position illustrated in FIG. 6 and an unlatching position (not shown) displaced clockwise from the showing of FIG. 6.

The latch element 188 is biased toward a latch closed position by a torsion spring 198 disposed around the collar 194 having one end hooked about a post 200 with the other end hooked about one side of the member 190. An electrically powered motor 202 provides a rotary output 204 having a worm gear 206 on the end thereof engaging a sector gear 208 mounted on a post 210. A lost motion connection 212 comprising a slot 214 in the sector gear 208 and a link 216 acts to connect the sector gear 208 to the latch member 190.

Figure 7:
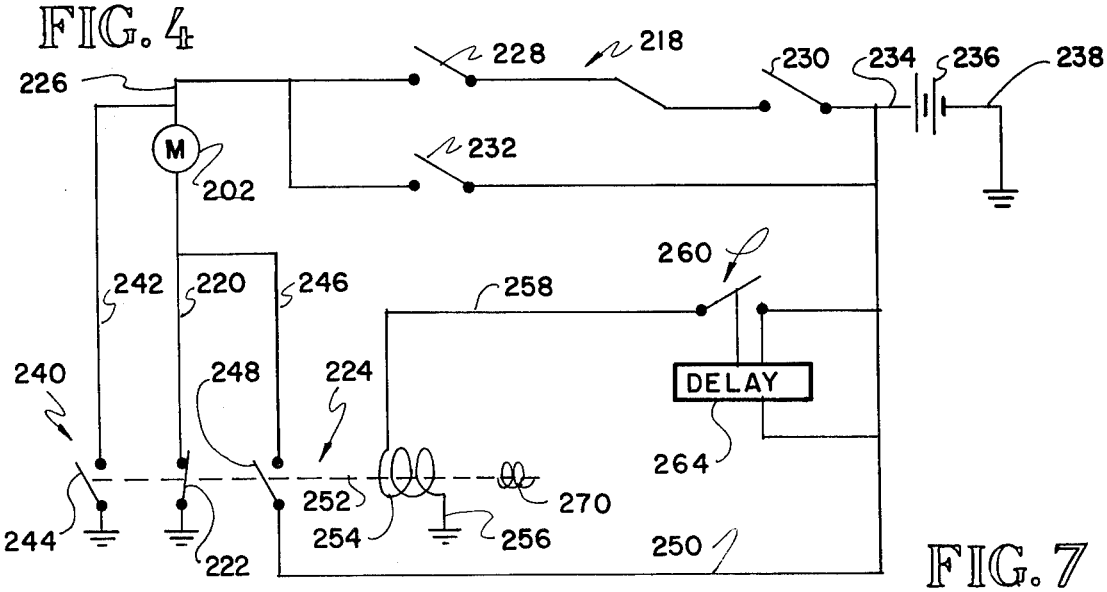
FIG. 7 is a schematic diagram of an electric circuit suitable to energize the mechanism of FIG. 6.

Referring to FIG. 7, there is illustrated a circuit 218 for energizing the motor 202 and thereby setting into operation the closure latch 186. The circuit 218 includes the motor 202 in which one lead 220 thereof is grounded through a normally closed switch leg 222 of a relay 224 more fully explained hereinafter. The other lead 226 of the motor 202 is connected to a switch network comprising a dash mounted switch 228 in series with an ignition switch 230 of the delivery truck. A key operated switch 232 adjacent the closure latch 186 is in parallel with the switches 228, 230. The switching network is connected by a lead 234 to a battery 236 or other suitable source of power having a grounded lead 238. It will accordingly be apparent that the mechanism 202 can be actuated in an unlatching direction either by manipulating the dash mounted switch 228 before the ignition switch 230 is opened or by actuating the key operated switch 232.

The circuit 218 also comprises a motor reversing network 240 which includes the relay 224. The network 240 includes a ground lead 242 having therein a normally open switch leg 244 and a second lead 246 connected through a normally open switch leg 248 to a lead 250 connected to the battery 236. The relay 224 includes a reciprocable connection 252 secured to each of the switch legs 222, 244 and having disposed therearound a relay coil 254. One leg of the relay coil 254 is grounded through a lead 256 while the other leg of the coil 254 is connected to a lead 258 having therein a switch 260 and a delay mechanism 264 for purposes more fully explained hereinafter. The lead 258 is connected to the battery 236.

As shown best in FIG. 6, the switch 260 comprises a housing 266 having an actuator 268 extending therethrough in the path of movement of the sector gear 208. After the sector gear 208 has moved in a clockwise direction sufficient to unlatch the latch thereby closing the switch 260 and energizing the relay coil 254. Energizing the coil 254 moves the reciprocable connection 252 to the right in FIG. 7 thereby closing the normally open switch legs 244, 248 and opening the normally closed switch leg 222.

As soon as the sector gear 208 moves in a counterclockwise direction sufficient to unlatch the latch element 188, the spring stop biases the striker upwardly and out of latching engagement with the latch element 188. Actuation of the relay 224 causes the motor 202 to reverse thereby driving the worm gear 206 and ultimately driving the sector gear 208 in a counterclockwise direction. Without the delay 264, the switch 260 would open almost immediately thereby stopping the motor 202. The delay 264 accordingly maintains the switch 260 in a closed position for a sufficient time to allow the sector gear 208 to return to the position illustrated in FIG. 6. Because of the lost motion connection 212, driving the sector gear 208 in a counterclockwise direction does not affect the position of the latch element 188.

The relay 224 is illustrated in FIG. 7 in its normal position under the bias of a spring 270. Upon opening of the switch 260 and deenergizing the relay coil 254, the spring 270 returns the reciprocable connection 252 to the position illustrated in FIG. 7 wherein the switch leg 222 is closed and the switch legs 244, 248 are opened.

In use, the device of FIG. 6 operates in a manner substantially identical to the devices of FIGS. 2 and 5.

One of the advantages of the latch arrangement of this invention is that it is readily unlatched from inside the closure 18. Specifically, the free ends of the latch members 30, 128, 188 are readily accessible from the inside of the enclosure 18. This is of substantial importance when loading the delivery truck 10 which is normally accomplished through a rear door (not shown) which is closed and locked from the inside. The person loading the truck 10 may then walk through the enclosure 18, unlatch the latch member and walk out of the bulkhead door 20.

Although the invention has been described in its preferred embodiments with a certain degree of particularity, it is understood that the present disclosure of the preferred forms has been made only by way of example and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

I claim:

1. A delivery truck comprising a wheeled chassis; means for propelling the chassis along the roadway; a source of electrical power; an enclosure, of sufficient height for an adult to stand, for carrying articles and having a closure opening, a closure member and means mounting the closure member for movement in a path between positions opening and closing the opening and a power operating latching device for latching the closure member in the closed position and for unlatching the closure member, the latching device comprising a striker mounted on the closure member for movement in the path between the open and closed position;

a framework mounted adjacent the closure opening comprising a plate member having a platform extending transversely thereto and providing a pair of generally parallel slots extending generally parallel to the plate member;

a latch pivotally mounted on the frame work for movement between the latching and unlatching positions for retaining the striker in the closed position, the latch extending through one of the slots, the other slot allowing use of the member with a differently configured latch and being biased toward the latched position and including a cam face for engaging the striker during movement thereof toward the door closed position for moving the latch toward the unlatched position and clearing the striker at the door closed position allowing the latch to move toward the latched position;

an electrically powered mechanism having an output capable of opening movement when the mechanism is energized and means drivably connecting the output to the latch for moving the latch to the unlatched position thereof upon energizing the mechanism;

an electric circuit including a normally open switch and a truck source of electrical power operative connected to the mechanism for energizing the same;

a mechanically operable unlatching device for moving the latch from the latched to the unlatched position and for moving the connecting means in the opening direction; and means accessible from inside the enclosure for moving the latch to the unlatched position.

2. The device of claim 1 further comprising means biasing the striker, in the closed position, toward the open position thereof.

3. The device of claim 1 wherein the mechanically operable unlatching device comprises a lock extending through the framework having a shaft inside the enclosure and movable in response to keyed movement of the lock; and a cam, on one end of the shaft, for moving the latch from the latched to the unlatched position.

4. The device of claim 1 wherein the connecting means comprises means uninterruptedly connecting the mechanism output to the latch.

5. The device of claim 4 wherein the mechanism includes means normally biasing the output and the latch toward the latched position and electrically energized means for moving the output to the unlatched position.

6. The device of claim 5 wherein the electrically energized means is a solenoid.

7. The device of claim 1 wherein the latch comprises a generally linear member pivotally mounted on a member extending perpendicularly from the plate member.

8. The device of claim 1 wherein the latch comprises a first latch element extending through the slot closest to the plate member and the second latch element disposed beneath the platform in alignment with the other slot and connected to the first latch element, the first latch element being pivotally mounted on a member extending perpendicularly from the plate member, the second latch element being secured to the connecting means.

* * * * *